US005692355A

United States Patent [19]

Liao

[11] Patent Number: 5,692,355

[45] Date of Patent: Dec. 2, 1997

[54] PROCESS FOR FORMING STEEL SHUTTERING FRAME

[76] Inventor: Fu-chang Liao, No. 20, Alley 10, Lane 99, Chunghua Rd., Chunan Chen, Miaoli Hsien, Taiwan

[21] Appl. No.: 581,899

[22] Filed: Jan. 2, 1996

[51] Int. Cl.[6] ..... E04B 1/16

[52] U.S. Cl. ..... 52/742.14; 52/126.6; 52/745.02; 249/112; 249/119

[58] Field of Search ..... 52/742.14, 745.05, 52/126.6, 561, 745.02; 249/119, 112

[56] References Cited

U.S. PATENT DOCUMENTS

| | | | |
|---|---|---|---|
| 4,062,514 | 12/1977 | Scott-King | 249/191 X |
| 4,085,495 | 4/1978 | Hebert | 249/191 X |
| 5,456,444 | 10/1995 | Wegman | 249/119 X |

*Primary Examiner*—Christopher Kent
*Attorney, Agent, or Firm*—Sixbey, Friedman, Leedom & Ferguson PC; Stuart J. Friedman

[57] ABSTRACT

A process for forming a steel shuttering frame for a building with a reinforced concrete structure. The process includes the following steps: (1) setting up a supporting stand for the shuttering frame, (2) mounting shutter plates for forming a floor portion of the building on a top of the supporting stand, (3) mounting inside shutter plates for forming inner surfaces of side walls of the building on sides of the supporting stand, (4) mounting outside shutter plates for forming outer surfaces of the side walls of the building around the inside shutter plates, and (5) fixedly connecting the inside and outside shutter plates together while keeping them separated from each other a predetermined distance equal to the thickness of the side walls of the building.

16 Claims, 3 Drawing Sheets

PROCESS FOR FORMING STEEL SHUTTERING FRAME

FIELD OF THE INVENTION

The present invention is related to a process for forming a steel shuttering frame for constructing a building with a reinforced concrete structure.

BACKGROUND OF THE INVENTION

A conventional shuttering frame consists of a plurality of wooden shutter plates which have the following disadvantages. Wooden shutter plates have a tendency to be easily damaged since they are relatively weak. Furthermore, the surface of the wooden shutter plate is not smooth enough so that after the wooden shutter plates are removed from the completed concrete structure, the surface of the concrete always needs further processing, for example, plastering. Moreover, each wooden shutter plate has a different performance about its ability to withstand the load of concrete so that when the concrete is poured into the conventional shuttering frame, an unpredicted deformation of the shutter (s) may happen, which will cause a leakage of the concrete slurry from the shuttering frame.

The present invention is disclosed to obviate/mitigate the above mentioned disadvantages of the conventional wooden shuttering frame.

SUMMARY OF THE INVENTION

It is an objective of the present invention to provide a process to construct a steel shuttering frame.

A further objective of the present invention is to provide a process to construct a steel shuttering frame constituted of steel shutter plates having a uniform quality so that an unpredicted deformation of the shutter(s) will not happen when concrete slurry is poured into the steel shuttering frame constructed in accordance with the present invention.

It is a further objective of the present invention to provide a process to construct a steel shuttering frame which has steel shutter plates each having a smooth surface so that the completed concrete can have a smooth surface which does not need further processing.

It is still a further objective of the present invention to provide a very efficient process to construct a steel shuttering frame.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
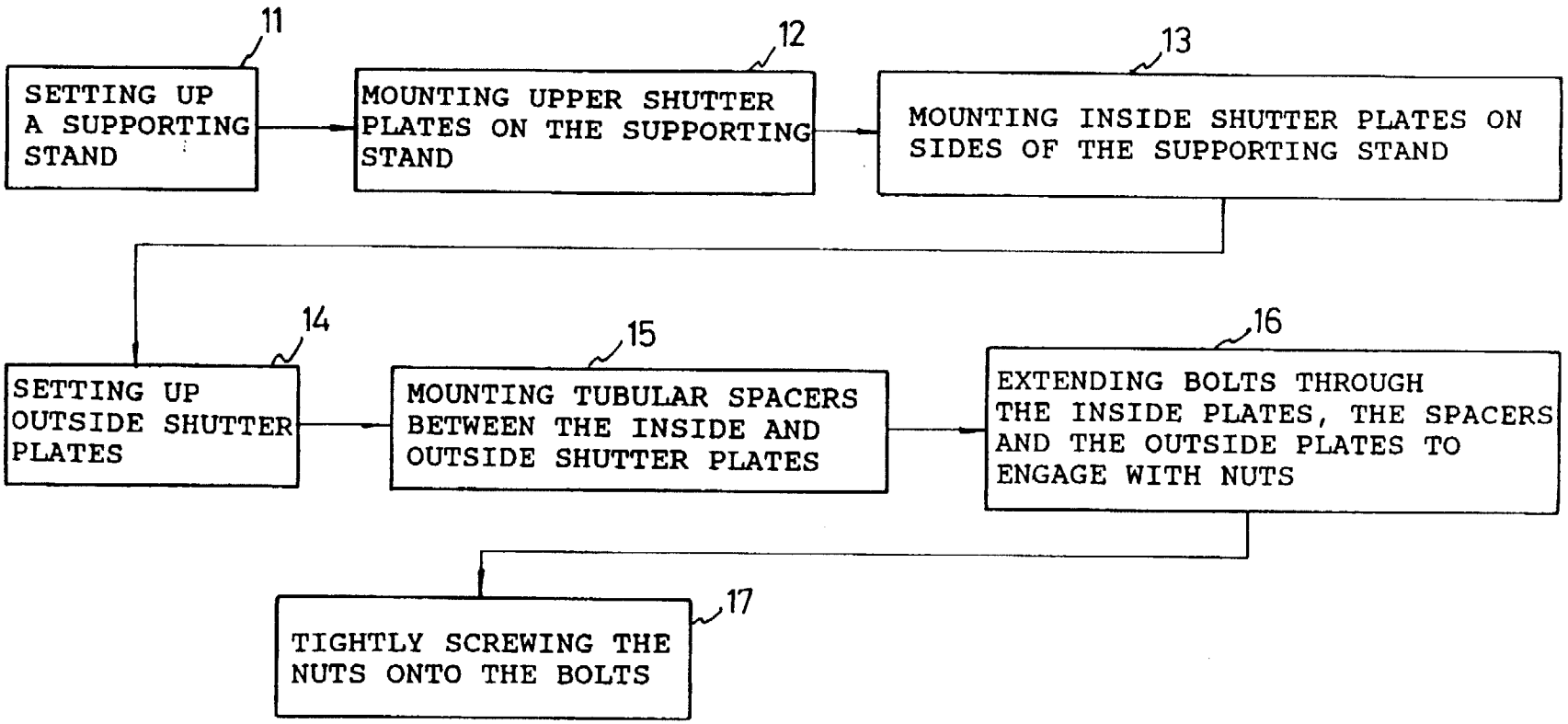
FIG. 1 is a flow chart showing the steps of a process for forming a steel shuttering frame in accordance with the present invention.

Refer to FIG. 1, which shows a flow chart of the present invention for constructing a steel shuttering frame. According to the flow chart of FIG. 1, the present invention generally comprises seven main steps of operation respectively indicated by reference numbers 11, 12, 13, 14, 15, 16 and 17.

Reference number 11 represents setting up a supporting stand for the shuttering frame. Then, reference number 12 refers to mounting upper shutter plates 3 (also referring to FIG. 2) for forming a floor portion of a building on a top of the supporting stand and connecting these upper shutter plates 3 together. Reference number 13 refers to connecting inside shutter plates 5 for forming inner surfaces of side walls of the building and side sheets 4 together, and, then, mounting the inside shutter plates 5 on sides of the supporting stand by inserting a top side extension of the side sheets 4 into a location between the top of the supporting stand and the upper shutter plates. Reference number 14 refers to setting up outside shutter plates 6 for forming outer surfaces of the side walls of the building. Reference 15 refers to mounting tubular spacers 7 between the inside and outside shutter plates 5, 6. Reference number 16 refers to extending bolts 70 from an inside of the inside plates 5 through the tubular spacers 7 and threadedly engaging the bolts 70 with nuts 71 from an outside of the outside plates 6. Finally, reference number 17 refers to tightly screwing the nuts 71 onto the bolts 70 thereby fixedly connecting the inside and outside plates 5 and 6 together.

A detailed description about using the present invention to construct the steel shuttering frame will now be disclosed with reference to FIGS. 2, 3, 4 and 5.

The present process for constructing a steel shuttering frame includes the following steps of operation.

The first step of the present process is to set up a supporting stand. The supporting stand is composed of several (four in this embodiment) sheeting supports 1, supporting beams 2 and H-shaped reinforcing beams 20. The connections among the sheeting supports 1, the supporting beams 2 and the reinforcing beams 20 are obtained by bolts and nuts so that the whole supporting stand can be disassembled to facilitate a transportation and storage thereof. Each sheeting support 1 is divided into a rod and a base wherein the rod is threadedly connected with the base so that the height of the sheeting support 1 can be adjusted by screwing the rod into or out of the base.

Then, upper steel shutter plates 3 for forming a floor portion of a building with a reinforced concrete structure are laid on the H-shaped reinforcing beams 20 of the supporting stand. Each upper shutter plate 3 is configured to have a generally rectangular shape with a stepped end for cooperating with the stepped ends of other upper shutter plates 3 to define a recess for forming a beam of the building. Each upper shutter plate 3 is arranged to closely contact and align with its corresponding neighboring upper shutter plates. If there is any gap between two neighboring upper shutter plates 3, plaster can be used to fill the gap. Each upper shutter plate 3 has two parallel rows of holes 30 on its two longitudinal side edges. Each hole 30 is defined by a threaded periphery. Hereafter, the holes 30 are termed as threaded holes 30.

Figure 4:
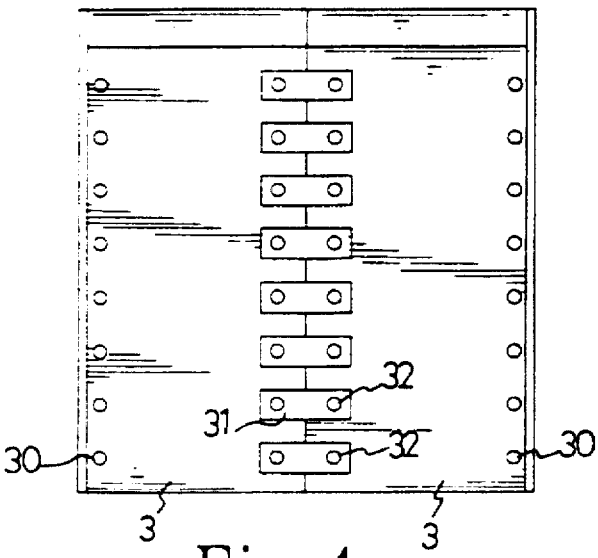
FIG. 4 is a plane view showing that two steel shutters used by the present invention are connected together by a plurality of connecting tabs and screws.
Figure 5:
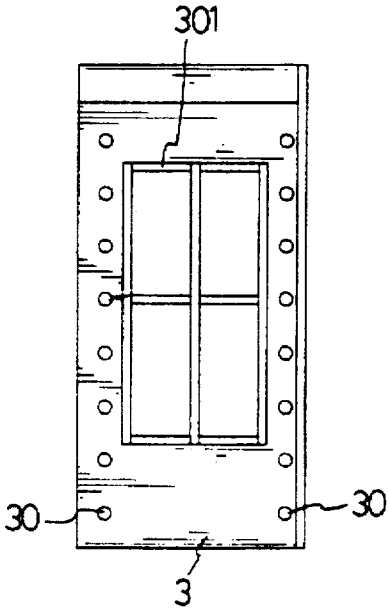
FIG. 5 is a plane view showing an alternative embodiment of the steel shutters used by the present invention.

Thereafter, a plurality of connecting steel tabs 31 and screws 32 are used to connect two longitudinally neighboring upper shutter plates 3 together by extending the screws 32 through two holes 33 defining on the tab 31 and threadedly engaging the screws 32 respectively with a corresponding pair of threaded holes 30 respectively on the two longitudinally neighboring upper shutter plates 3 (also referring to FIG. 4).

Figure 2:
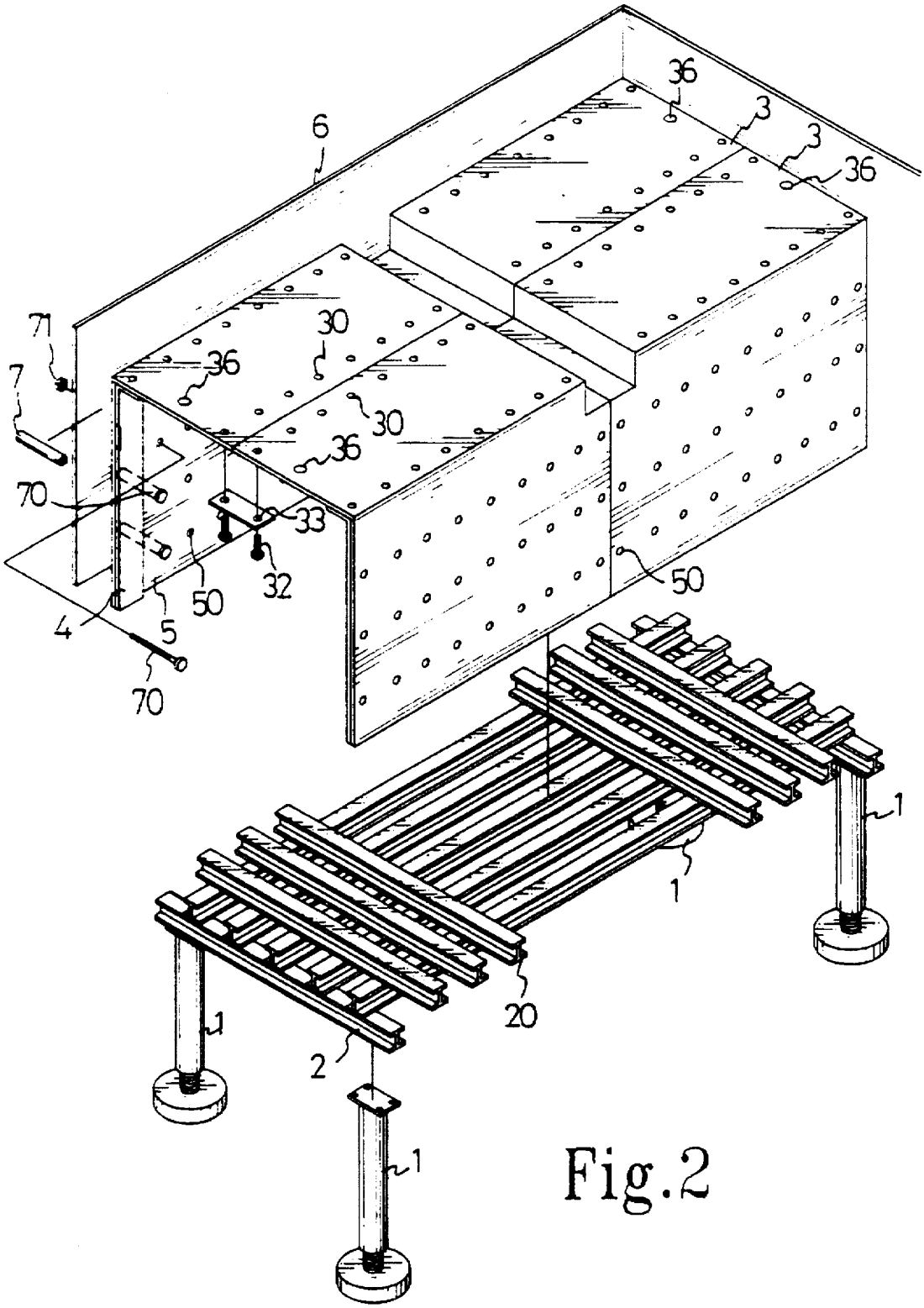
FIG. 2 is a perspective, exploded view of a steel shuttering frame constructed by the present invention.

Particularly referring to FIG. 2, the distance between the holes 33 of the tab 31 is designed to be the same as that between the corresponding pair of threaded holes 30 respectively in the two longitudinally neighboring upper shutter plates 3. The quantity of the connecting tabs 31 necessary to be used to connect two neighboring upper shutter plates 3 together is decided by the actual operating condition of the building. For example, when the floor portion of the building is designed to have a larger thickness, the quantity of the tabs 31 necessary to connect the upper shutter plates 3 together should be in a larger number accordingly thereby to create a firmer connection between the upper shutter plates in order to resist a larger pressure caused by the concrete poured onto the upper shutter plates 3.

The upper shutter plates 3 can have smooth top and bottom surfaces. Alternatively, referring to FIG. 5, the bottom surface, which is not in contact with concrete, can be formed to have reinforcing ribs 301 to enhance the rigidity of the upper shutter plates 3.

Thereafter, several side sheets 4 are brought to be connected with inside shutter plates 5 together by a known means, for example nuts and bolts. The inside shutter plates 5 are used to form inner surfaces of side walls of the building. The side sheets 4 are used to mount the inside shutter plates 5 on sides of the supporting stand by inserting a top side extension of the side sheets 4 into a location between the upper shutter plates 3 and end portions of the reinforcing beams 20 of the supporting stand (better seen in FIG. 3). Due to the weight of the upper shutter plates 3, the side sheets 4 together with the inside shutter plates 5 can be fixed in position. Three parallel rows of holes 50 are defined on each of the inside shutter plates 5. Each hole 50 is defined by a threaded periphery. Hereafter the holes 50 are termed as threaded holes 50. In a manner like the connection of the upper shutter plates 3, two neighboring inside plates 5 are connected together by using tabs 31 and screws 32. The screws 32 extend through the holes 33 of the tab 31 and threadedly engage a pair of corresponding threaded holes 50 located respectively on end sides of the two neighboring inside shutter plates 5, wherein the end sides of the two neighboring inside shutter plates 5 are aligned and contacted with each other. If there is any gap exited between two neighboring inside shutter plates 5, plaster can be used to fill the gap.

Particularly referring to FIG. 2, each inside shutter plate 5 has a cutout at one of its top corners. The cutout is configurated to cooperate with the stepped end of the corresponding upper shutter plate 3, with which the inside shutter plate 5 is contacted, thereby to form the recess for forming the beam of the building.

Thereafter, outside shutter plates 6 are set up around the inside shutter plates 5 after a necessary reinforcement and piping for water, electric or telephone wire has been laid around the inside shutter plates 5 and on the upper shutter plates 3. Like the inside shutter plates 5, each of the outside shutter plates 6 also have three parallel rows of holes 72. Each hole 72 is defined by a threaded periphery. Hereafter the holes 72 are termed as threaded holes 72. The outside shutter plates 6 are used for forming outer surfaces of the side walls of the building. Two neighboring outside shutter plates 6 are connected together in a manner like that connecting the inside shutter plates 5. If there is any gap exited between two neighboring outside shutter plates 6, plaster can be used to fill the gap. When the outside shutter plates 6 are connected together and set around the inside shutter plates 5 a predetermined distance which is equal to the required thickness of the side walls of the building, and each threaded hole 72 on the outside shutter plates 6 is aligned with a corresponding threaded holes 50 on the inside shutter plates 5, screws 70, nuts 71 and tubular spacers 7 are used to connect the inside and outside shutter plates 5 and 6 together, which will be more detailedly discussed below.

The tubular spacers 7 which have a length substantially the same as the thickness of the side walls of the building are disposed into the space between the inside and outside shutter plates 5 and 6 to be aligned with a selected corresponding pair of threaded holes 50 and 72. Then, the bolts 70 are brought to extend from an inside of the inside plates 5 through the tubular spacers 7 and threadedly engage with the nuts 71 from an outside of the outside plates 6. Finally, the nuts 71 are tightly screwed onto the bolts 70 to thereby fixedly connect the inside and outside plates 5 and 6 together while, due to the action of the tubular spacers 7, the predetermined distance between inside and outside shutter plates 5, 6 is maintained. Thus, the steel shuttering frame in accordance with the present invention is completed.

Then, concrete can be poured on the upper shutter plates 3 and into the space between the inside and outside shutter plates 5, 6 of the shuttering frame to obtain a building structure of reinforcing concrete as shown by FIG. 2.

After the concrete is sufficiently hard, a removal of the shuttering frame is performed. Concerning the removal of the shuttering frame, the first step is to remove the supporting stand from the building site. Then, the engagement between the screws 70 and nuts 71 is released to thereby facilitate a removal of the inside shutter plates 5 together with the side sheets 4 and the outside shutter plates 6 from the side walls of the side walls of the building. Finally, the upper shutter plates 3 are removed from the floor portion of the building.

After the removal of the shuttering frame, the tubular spacers 7 remain within the side walls. Since the tubular spacers 7 have a relatively small dimension: each having an outer diameter of 10 millimeter (mm) and an inner diameter of 6 millimeter, the tubular spacers 7 will not affect the structural integrality and strength of the side walls. Voids may occur in the surfaces of the side walls, those voids are caused by the hollow portions of the tubular spacers 7, a simple plastering can be done to fill these voids so that a very smooth surface of the side walls can be obtained.

In a further preferred embodiment, between the steps as indicated by the reference numbers 11 and 12 of FIG. 1, a further step can be provided. The further step includes providing several plastic sleeves 34 positioned on the upper shutter plates 3 and aligned with several of the threaded holes 30, and extending steel ropes 35 into the sleeves 34 and fixedly engaging the steel ropes 35 with the threaded holes 30. The fixed engagement between each of the steel ropes 35 and the threaded holes 30 can be obtained by, for example, threadedly extending a screw fixedly attached on an end of the rope 35 into the threaded hole 30. The sleeves 34 have a height dimensioned substantially larger than the thickness of the concrete floor; thus, when pouring the concrete, the concrete slurry will not enter into the sleeves 34 and harden therein. The steel ropes 35 are used to exert a pulling force by means of a winding machine (for example, a hoisting gear) on the upper shutter plates 3 when the construction of the building is complete and the supporting stand for the shuttering frame is moved away from the building site, thereby to prevent an unexpected falling of the upper shutter plates 3. Thereafter the pulling force of the ropes 35 acting on the upper shutter plates 3 can be decreased so that the upper shutter plates 3 can be slowly lowered until they reach the ground.

Figure 3:
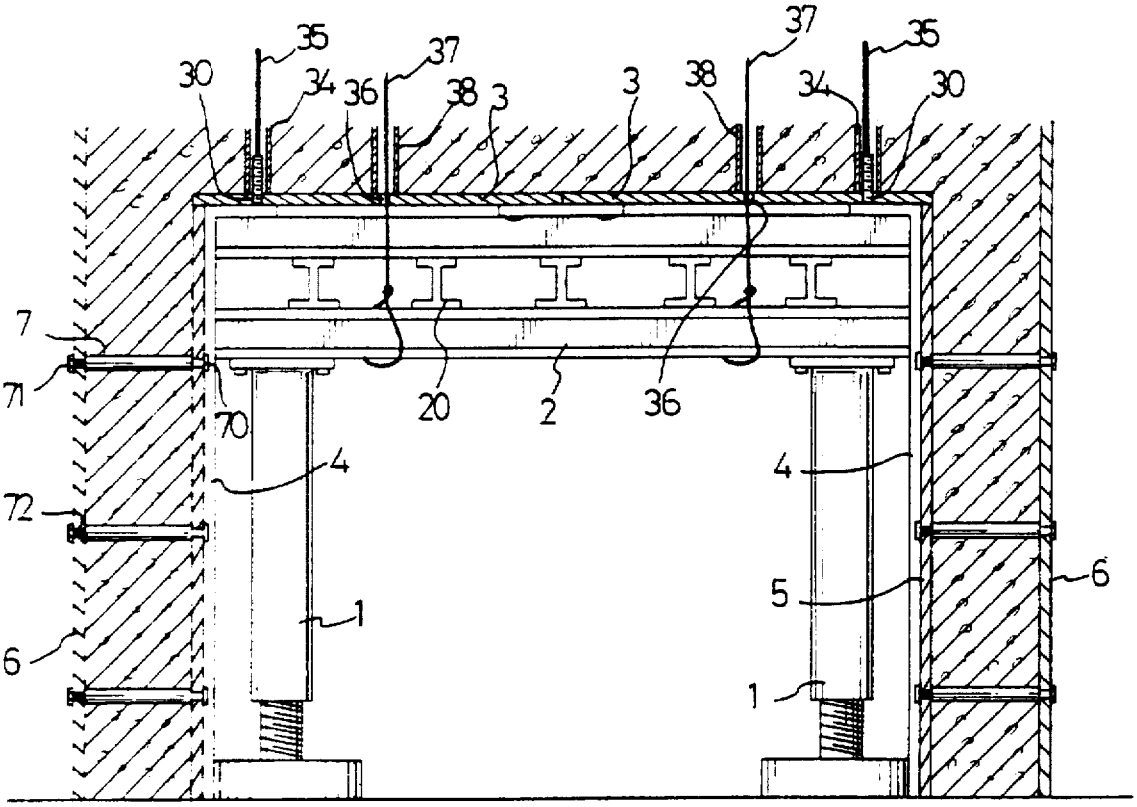
FIG. 3 is a cross-sectional view showing a shuttering frame constructed by the present invention, wherein concrete is filled in the shuttering frame.

In a still further preferred embodiment, a hole 36 (FIG. 2) is defined in each of the top shutter plates 3 and located at a longitudinal central line, near an edge thereof. Turning to FIG. 3, plastic sleeves 38 are respectively provided on the upper shutter plates 3 and aligned with the holes 36. Steel ropes 37 are respectively extended through the sleeves 38 and the holes 36 to be tightly anchored onto the supporting beam 2. The steel ropes 37 are used to exert a pulling force on the supporting beams reinforcing beams 2 and the H-shaped reinforcing beams 20 of the supporting stand. In this preferred embodiment, when the shuttering frame is removed from the building, firstly the sheeting supports 1 are detached from the supporting stand. Then, the ropes 37 are released to lower the supporting and reinforcing beams 2 and 20 to the ground. Thereafter, the ropes 35 are released to lower the top shutter plates 3 to the ground.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A process for forming a steel shuttering frame for constructing a building with a reinforced concrete structure, comprising the following steps:

setting up a supporting stand for the shuttering frame;

mounting upper shutter plates for a floor portion of the building on a top of the supporting stand and connecting the upper shutter plates together;

mounting inside shutter plates for forming inner surfaces of side walls of the building on sides of the supporting stand and connecting the inside shutter plates together;

mounting outside shutter plates for forming outer surfaces of the side walls of the building around the inside shutter plates, connecting the outer shutter plates together, and spacing the outside shutter plates from the inside shutter plates a predetermined distance; and tightly connecting the inside and outside shutter plates together while keeping the predetermined distance unchanged.

2. The process according to claim 1, wherein the height of the supporting stand is adjustable.

3. The process according to claim 2, wherein the supporting stand comprises four sheeting supports each having a base and a rod threadedly connected with the base, a plurality of supporting beams threadedly connected with the rods and a plurality of H-shaped reinforcing beams threadedly connected with the supporting beams.

4. The process according to claim 1, wherein a plurality of holes is defined in each of the upper, inside and outside shutter plates, each hole defining a threaded periphery, and the connecting of the upper, inside and outside shutter plates is obtained by extending at least two screws through a connecting tab and threadedly engaging the screws with at least two threaded periphery holes located respectively at two neighboring shutter plates.

5. The process according to claim 4, wherein the threaded periphery holes on each shutter plate are arranged into at least two parallel rows.

6. The process according to claim 1, wherein before the outside shutter plates are set up around the inside shutter plates, a necessary reinforcement and piping for water, electric or telephone wire are laid around the inside shutter plates and on the upper shutter plates.

7. The process according to claim 1, wherein at least one tubular spacer is inserted between the inside and outside shutter plates so that when the inside and outside shutter plates are tightly connected together, the predetermined distance between the inside and outside shutter plates is maintained.

8. The process according to claim 7, wherein the tight connection between the inside and outside shutter plates is obtained by means of at least one set of a bolt and nut wherein the bolt is extended through a pair of corresponding threaded holes respectively defined in the inside and outside shutter plates and the tubular spacer and tightly engaged with the nut.

9. The process according to claim 7, wherein the tubular spacer has a length the same as the predetermined distance, an outer diameter of 10 millimeters and an inner diameter of 6 millimeters.

10. The process according to claim 8, wherein the bolt of each set is tightly engaged with the corresponding nut of each set from an outside of the outside shutter plates.

11. The process according to claim 1 further comprising a step immediately following the step to mount the upper shutter plates, wherein the further step comprises providing several sleeves on the upper shutter plates and extending steel ropes into the sleeves and fixedly engaging the steel ropes with the upper shutter plates.

12. The process according to claim 1, wherein the mounting of the inside shutter plates to sides of the supporting stand is achieved by firstly connecting the inside shutter plates to side sheets each having a top side extension, and then inserting the top side extensions into a location between the top of the supporting stand and the upper shutter plates.

13. The process according to claim 1, wherein each of the shutter plates has two major surfaces with one surface being smooth in appearance and the other being equipped with reinforcing ribs.

14. The process according to claim 1, wherein each of the shutter plates has two major surfaces both of which are smooth in appearance.

15. The process according to claim 11 wherein the floor portion of the building has a thickness and a height of the sleeve is adopted to be substantially larger than the thickness of the floor portion of the building.

16. The process according to claim 1 further comprising a step to use plaster to fill a gap between two neighboring top shutter plates, inside shutter plates or outside shutter plates.

* * * * *